US010745826B2

(12) United States Patent
Uchida et al.

(10) Patent No.: US 10,745,826 B2
(45) Date of Patent: Aug. 18, 2020

(54) NOZZLE HEAD AND ELECTROSPINNING APPARATUS

(71) Applicant: Kabushiki Kaisha Toshiba, Minato-ku (JP)

(72) Inventors: Kenya Uchida, Yokohama (JP); Shizuo Kinoshita, Yokohama (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 236 days.

(21) Appl. No.: 15/460,793

(22) Filed: Mar. 16, 2017

(65) Prior Publication Data

US 2017/0268129 A1 Sep. 21, 2017

Related U.S. Application Data

(63) Continuation of application No. PCT/JP2016/076106, filed on Sep. 6, 2016.

(30) Foreign Application Priority Data

Mar. 16, 2016 (JP) ..... 2016-052912

(51) Int. Cl.
*D01D 4/04* (2006.01)
*B05B 15/68* (2018.01)
*D01D 5/00* (2006.01)

(52) U.S. Cl.
CPC ..... *D01D 4/04* (2013.01); *B05B 15/68* (2018.02); *D01D 5/0069* (2013.01)

(58) Field of Classification Search
CPC ..... D01D 4/04; D01D 5/0069; D01D 5/0061; D01D 5/0007; B29C 47/12; B05B 15/68
See application file for complete search history.

(56) References Cited

U.S. PATENT DOCUMENTS 4,190,015 A * 2/1980 Hillman ..... B05B 15/50 118/696
5,676,756 A 10/1997 Murate et al.
2002/0122840 A1 9/2002 Lee et al.
(Continued)

FOREIGN PATENT DOCUMENTS

JP 6-134354 5/1994
JP 9-47698 2/1997
(Continued)

OTHER PUBLICATIONS

International Search Report dated Dec. 13, 2016 in PCT/JP2016/076106 filed on Sep. 6, 2016 (with English Translation of Categories of Cited Documents).
(Continued)

*Primary Examiner* — Philip C Tucker
*Assistant Examiner* — Jimmy R Smith, Jr.
(74) *Attorney, Agent, or Firm* — Oblon, McClelland, Maier & Neustadt, L.L.P.

(57) ABSTRACT

According to one embodiment, a nozzle head includes a main body having a space in an interior of the main body, the space being capable of storing a source material liquid, a first nozzle provided at the main body, the first nozzle ejecting the source material liquid stored in the main body, and a second nozzle provided at the main body, the second nozzle supplying a cleaning liquid to a vicinity of an outlet of the first nozzle.

2 Claims, 3 Drawing Sheets

(56) References Cited

U.S. PATENT DOCUMENTS

| | | | | |
|---|---|---|---|---|
| 2005/0067732 | A1* | 3/2005 | Kim | D01D 5/0038 264/172.19 |
| 2010/0310757 | A1* | 12/2010 | Ooshiro | B05C 5/0291 427/8 |
| 2012/0034461 | A1* | 2/2012 | Stevens | D01D 5/0069 428/375 |
| 2015/0075423 | A1 | 3/2015 | Kishi et al. | |

FOREIGN PATENT DOCUMENTS

| | | |
|---|---|---|
| JP | 2002-201559 | 7/2002 |
| JP | 2007-303015 | 11/2007 |
| JP | 2010-236133 | 10/2010 |
| JP | 2010-279932 | 12/2010 |
| JP | 2011-94281 | 5/2011 |
| JP | 2015-60932 | 3/2015 |
| WO | WO 2016/035458 A1 | 3/2016 |

OTHER PUBLICATIONS

Written Opinion dated Dec. 13, 2016 in PCT/JP2016/076106 filed on Sep. 6, 2016.

* cited by examiner

NOZZLE HEAD AND ELECTROSPINNING APPARATUS

CROSS-REFERENCE TO RELATED APPLICATIONS

This application is based upon and claims the benefit of priority from the Japanese Patent Application No. 2016-052912, filed on Mar. 16, 2016, and the PCT Patent Application PCT/JP2016/076106, filed on Sep. 6, 2016; the entire contents of which are incorporated herein by reference.

FIELD

An embodiment of the invention relates to a nozzle head and an electrospinning apparatus.

BACKGROUND

There is an electrospinning apparatus in which a fine fiber is deposited on the surface of a member by electrospinning (also called electric field spinning, charge-induced spinning, etc.).

A nozzle that ejects a source material liquid is provided in the electrospinning apparatus. Also, a needle-type nozzle head that includes multiple needle-shaped nozzles has been proposed; and a blade-type nozzle head in which multiple nozzles are provided in a plate configuration has been proposed.

In such a nozzle head, when the source material liquid is ejected continuously for a long time or when the ejecting and the stopping of the ejecting of the source material liquid are repeatedly performed, there are cases where the source material liquid adheres to the tip of the nozzle, and the source material liquid adhered to the tip of the nozzle coalesces by drying. If the source material liquid adheres to the tip of the nozzle, etc., there is a risk that the formation of the fiber may become unstable.

In such a case, although the operator may wipe the source material liquid adhered to the tip of the nozzle, the burden of the operator becomes too great. Also, there is a risk that the productivity may decrease because a long work time is necessary for the wiping.

Therefore, it is desirable to develop technology in which the cleaning of the nozzle can be performed easily.

DETAILED DESCRIPTION

Figure 1:
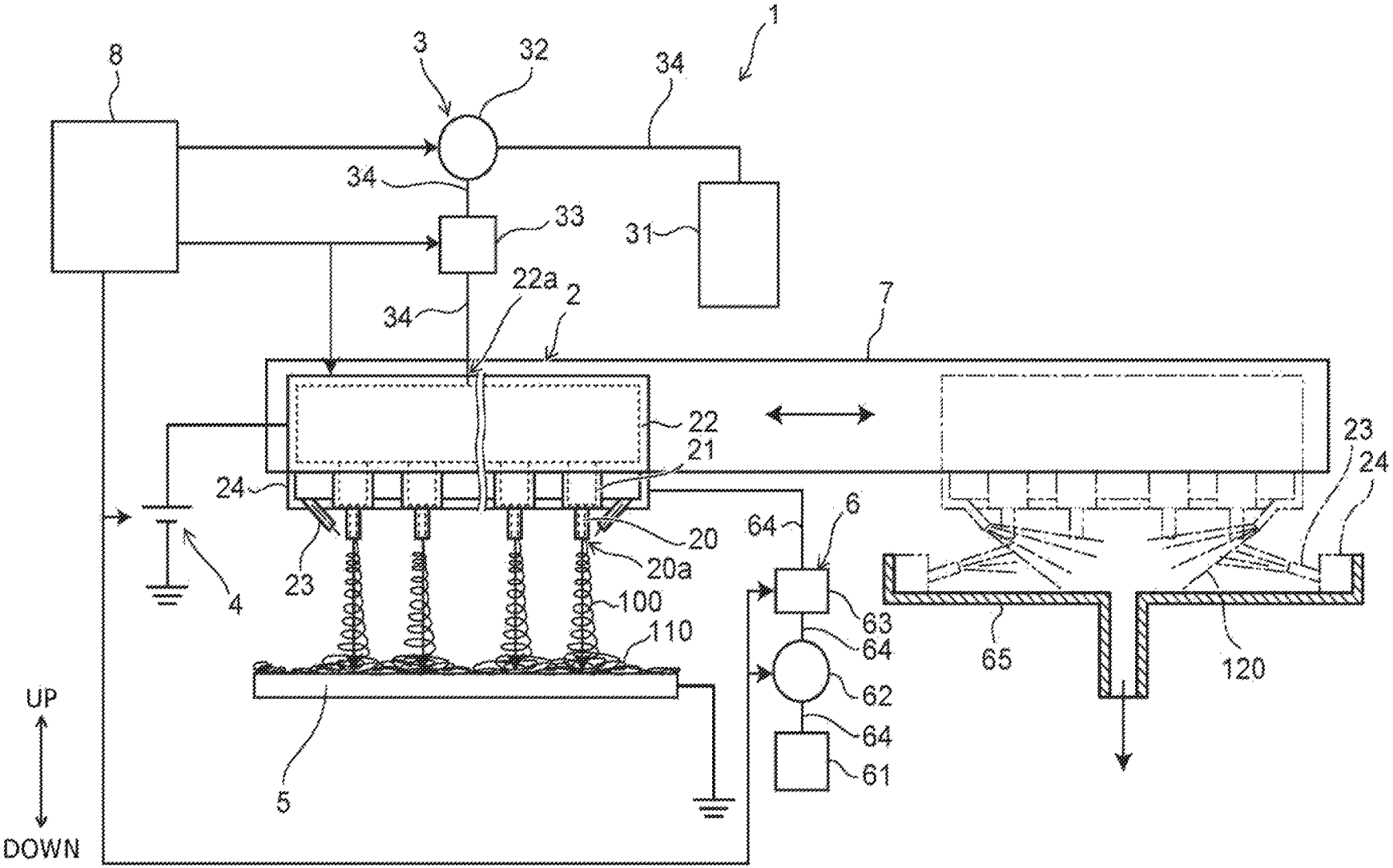
FIG. 1 is a schematic view for illustrating an electrospinning apparatus 1 and a nozzle head according to a first embodiment.

According to an embodiment, a nozzle head includes a main body having a space in an interior of the main body, the space being capable of storing a source material liquid, a first nozzle provided at the main body, the first nozzle ejecting the source material liquid stored in the main body, and a second nozzle provided at the main body, the second nozzle supplying a cleaning liquid to a vicinity of an outlet of the first nozzle.

Embodiments will now be illustrated with reference to the drawings. Similar components in the drawings are marked with the same reference numerals; and a detailed description is omitted as appropriate.

FIG. 1 is a schematic view for illustrating an electrospinning apparatus 1 and a nozzle head 2 according to the embodiment.

As shown in FIG. 1, the nozzle head 2, a source material liquid (hereafter, first liquid) supplier 3, a power supply 4, a collector 5, a cleaning liquid supplier 6, a movement part 7, and a controller 8 are provided in the electrospinning apparatus 1.

The nozzle head 2 includes a nozzle 20 (corresponding to an example of a first nozzle), a connector 21, a main body 22, a cleaning nozzle 23 (corresponding to an example of a second nozzle), and a base 24.

The nozzle 20 is provided at the main body 22 and ejects a first liquid stored in the main body 22.

The nozzle 20 is multiply provided at a prescribed spacing. The number of the nozzles 20 is not particularly limited and can be modified appropriately according to the size of the collector 5, etc.

The nozzle 20 has a needle-like configuration. A hole for ejecting the first liquid is provided in the interior of the nozzle 20. The hole for ejecting the first liquid communicates between the end portion of the nozzle 20 on a side of the connector 21 and the end portion (the tip) of the nozzle 20 on the side where the first liquid is ejected. An opening of the hole provided in the interior of the nozzle 20 on the side where the first liquid is ejected is an outlet 20*a*.

Although the outer diameter (in the case where the nozzle 20 has a cylindrical configuration, the diametrical dimension) of the nozzle 20 is not particularly limited, it is favorable for the outer diameter to be small. If the outer diameter is set to be small, electric field concentration occurs easily at the vicinity of the outlet 20*a* of the nozzle 20. If the electric field concentration occurs at the vicinity of the outlet 20*a* of the nozzle 20, the strength of the electric field generated between the collector 5 and the nozzles 20 can be increased. Therefore, the voltage that is applied by the power supply 4 can be set to be low. In other words, the drive voltage can be reduced. In such a case, the outer diameter of the nozzle 20 can be set to be, for example, about 0.3 mm to 1.3 mm.

The dimension (in the case where the outlet 20*a* is a circle, the diametrical dimension) of the outlet 20*a* is not particularly limited. The dimension of the outlet 20*a* can be modified appropriately according to the cross-sectional dimension of a fiber 100 to be formed. The dimension of the outlet 20*a* (the inner diameter of the nozzle 20) can be set to be, for example, not less than 0.1 mm and not more than 1 mm.

When the dimension of the outlet 20*a* is less than 0.1 mm, the burden of the liquid feeding becomes great because the pressure loss becomes large.

When the dimension of the outlet 20*a* exceeds 1 mm, there is a risk that the fiber 100 having the appropriate configuration and dimension cannot be formed because the eject state of the first liquid becomes unstable.

The nozzle 20 is formed from a conductive material. It is favorable for the material of the nozzle 20 to be conductive and to have resistance to the first liquid described below. For example, the nozzle 20 can be formed from stainless steel, etc.

The connector 21 is provided between the nozzle 20 and the main body 22. The connector 21 is not always necessary; and the nozzle 20 may be provided directly at the main body 22. A hole for supplying the first liquid from the main body 22 to the nozzle 20 is provided in the interior of the connector 21. The hole that is provided in the interior of the connector 21 communicates with the hole provided in the interior of the nozzle 20 and the space provided in the interior of the main body 22.

The connector 21 is formed from a conductive material. It is favorable for the material of the connector 21 to be conductive and to have resistance to the first liquid. For example, the connector 21 can be formed from stainless steel, etc.

The main body 22 has a plate configuration. A space where the first liquid is stored is provided in the interior of the main body 22. The nozzles 20 are multiply provided, with the connectors 21 interposed, at one end portion of the main body 22. The multiple nozzles 20 are provided to be arranged at a prescribed spacing. The arrangement form of the multiple nozzles 20 is not limited to the illustration. For example, the multiple nozzles 20 can be provided to be arranged in one column, can be provided to be arranged on a circumference or on concentric circles, or can be provided to be arranged in a matrix configuration.

Also, a supply port 22*a* is provided in the main body 22. The first liquid that is supplied from the first liquid supplier 3 is introduced to the interior of the main body 22 via the supply port 22*a*. The number and arrangement positions of the supply ports 22*a* are not particularly limited. For example, the supply port 22*a* can be provided on the side opposite to the side where the nozzles 20 of the main body 22 are provided.

The main body 22 is formed from a material having resistance to the first liquid. For example, the main body 22 can be formed from stainless steel, etc.

In the case of the illustration of FIG. 1, the cleaning nozzle 23 and the base 24 are provided at the main body 22. In other words, the cleaning nozzle 23 and the base 24 move together with the nozzles 20 and the main body 22.

The cleaning nozzle 23 is provided at the main body 22 with the base 24 interposed. The cleaning nozzle 23 supplies a cleaning liquid 120 to the vicinity of the outlet 20*a* of the nozzle 20.

For example, the cleaning nozzle 23 can have a needle-like configuration. A hole for supplying the cleaning liquid 120 is provided in the interior of the cleaning nozzle 23. The hole for supplying the cleaning liquid 120 communicates between the end portion of the cleaning nozzle 23 on a side of the base 24 and the end portion (the tip) of the cleaning nozzle 23 on the side where the cleaning liquid 120 is ejected.

The number, arrangement, etc., of the cleaning nozzles 23 are not limited to the illustration and can be modified appropriately according to the size of the nozzle head 2, the number and/or arrangement of the nozzles 20, etc.

The base 24 has a plate configuration. The space where the cleaning liquid 120 is stored is provided in the interior of the base 24. The cleaning nozzle 23 is provided at one end portion of the base 24. The hole that is provided in the cleaning nozzle 23 communicates with the space provided in the interior of the base 24.

The form, number, arrangement, etc., of the bases 24 are not limited to the illustration and can be modified appropriately according to the size of the nozzle head 2, the number and/or arrangement of the nozzles 20, etc.

The cleaning nozzle 23 and the base 24 can be formed from materials having resistance to the cleaning liquid 120 described below. For example, the cleaning nozzle 23 and the base 24 can be formed from a corrosion-resistant metal such as stainless steel or the like, a resin such as a fluoric resin or the like, an inorganic material such as a ceramic, etc.

In such a case, if the cleaning nozzle 23 and the base 24 are formed from a material that is conductive, there is a risk that the electric field generated between the collector 5 and the nozzles 20 may be affected; and the formation of the fiber 100 may become unstable. In such a case, if the distances between the cleaning nozzle 23 and the nozzles 20 and between the base 24 and the nozzles 20 are set to be long, the electric field that is generated between the collector 5 and the nozzles 20 is not affected easily. However, if the distances between the cleaning nozzle 23 and the nozzles 20 and between the base 24 and the nozzles 20 are set to be long, there is a risk that the cleaning of the nozzles 20 may be difficult.

Therefore, it is favorable for the cleaning nozzle 23 and the base 24 to be formed from a material that is insulative. Further, if the cleaning nozzle 23 and the base 24 are formed from a material having a high relative dielectric constant, the electric field generated between the collector 5 and the nozzles 20 is not affected easily.

For example, if the cleaning nozzle 23 and the base 24 are formed from a resin, an inorganic material, etc., having a relative dielectric constant of 2 or more, the electric field generated between the collector 5 and the nozzles 20 is not affected easily.

The first liquid supplier 3 supplies the first liquid to the main body 22.

The first liquid supplier 3 includes a container 31, a supplier 32, a first liquid controller 33, and a pipe 34.

The container 31 stores the first liquid. The container 31 is formed from a material having resistance to the first liquid. For example, the container 31 can be formed from stainless steel, etc.

The first liquid is a polymeric substance dissolved in a solvent.

The polymeric substance is not particularly limited and can be modified appropriately according to the material properties of the fiber 100 to be formed. For example, the polymeric substance can be polypropylene, polyethylene, polystyrene, polyethylene terephthalate, polyvinyl chloride, polycarbonate, nylon, aramid, etc.

It is sufficient for the solvent to be able to dissolve the polymeric substance. The solvent can be modified appropriately according to the polymeric substance to be dissolved. For example, the solvent can be water, methanol, ethanol, isopropyl alcohol, acetone, benzene, toluene, etc.

The polymeric substance and the solvent are not limited to the illustration.

As described below, the first liquid collects at the vicinity of the outlet 20*a* due to surface tension. To this end, the viscosity of the first liquid can be modified appropriately according to the dimension of the outlet 20*a*, etc. The viscosity of the first liquid can be determined by performing experiments and/or simulations. Also, the viscosity of the first liquid can be controlled by the mixture proportion of the solvent and the polymeric substance.

The supplier 32 supplies the first liquid stored in the container 31 to the main body 22. For example, the supplier 32 can be a pump that is resistant to the first liquid, etc. Also, for example, the supplier 32 may feed the first liquid stored in the container 31 by pressurizing by supplying a gas to the container 31.

The first liquid controller 33 controls the flow rate, pressure, etc., of the first liquid supplied to the main body 22 so that the first liquid in the interior of the main body 22 is not pushed out from the outlet 20*a* when new first liquid is supplied to the interior of the main body 22. The control amount for the first liquid controller 33 can be modified appropriately using the dimension of the outlet 20*a*, the viscosity of the first liquid, etc. The control amount for the first liquid controller 33 can be determined by performing experiments and/or simulations.

Also, the first liquid controller 33 may switch between the start of the supply and the stop of the supply of the first liquid. The supplier 32 and the first liquid controller 33 are not always necessary. For example, if the container 31 is provided at a position that is higher than the position of the main body 22, the first liquid can be supplied to the main body 22 by utilizing gravity. Then, the first liquid that is in the interior of the main body 22 can be caused not to be pushed out from the outlet 20*a* by appropriately setting the height position of the container 31. The height position of the container 31 can be modified appropriately using the dimension of the outlet 20*a*, the viscosity of the first liquid, etc. The height position of the container 31 can be determined by performing experiments and/or simulations.

The pipe 34 is provided between the container 31 and the supplier 32, between the supplier 32 and the first liquid controller 33, and between the first liquid controller 33 and the main body 22. The pipe 34 is used as a flow channel of the first liquid. The pipe 34 is formed from a material having resistance to the first liquid. For example, the pipe 34 can be formed from a fluoric resin, etc. Also, the pipe 34 can be flexible. If the pipe 34 is flexible, the movement of the nozzle head 2 described below is easy.

The power supply 4 applies a voltage to the nozzles 20 via the main body 22 and the connector 21. Not-illustrated terminals that are electrically connected to the multiple nozzles 20 may be provided. In such a case, the power supply 4 applies the voltage to the nozzles 20 via the not-illustrated terminals. In other words, it is sufficient for the voltage to be able to be applied to the multiple nozzles 20 from the power supply 4.

The polarity of the voltage applied to the nozzles 20 can be set to be positive or set to be negative. The power supply 4 illustrated in FIG. 1 applies a positive voltage to the nozzles 20.

The voltage that is applied to the nozzles 20 can be modified appropriately according to the type of the polymeric substance included in the first liquid, the distance between the collector 5 and the nozzles 20, etc.

In such a case, when the applied voltage is too low, there is a risk that the charge amount of the first liquid may be insufficient and the fiber 100 may no longer be formed.

When the applied voltage is too high, there is a risk that electro-discharge may occur outside and/or in the interior of the electrospinning apparatus 1; and the electrospinning apparatus 1 may be damaged.

For example, the power supply 4 can apply a voltage to the nozzles 20 so that the potential difference between the collector 5 and the nozzles 20 is 1 kV or more.

For example, the power supply 4 can be a direct current-high voltage power supply. For example, the power supply 4 can output a direct current voltage that is not less than 1 kV and not more than 100 kV.

The collector 5 is provided on the side of the multiple nozzles 20 where the first liquid is ejected. The collector 5 is grounded. A voltage that has the reverse polarity of the voltage applied to the nozzles 20 may be applied to the collector 5. The collector 5 can be formed from a conductive material. It is favorable for a material of the collector 5 to be conductive and to have resistance to the first liquid. For example, the material of the collector 5 can be stainless steel, etc.

For example, the collector 5 can have a plate configuration or a sheet configuration. In the case where the collector 5 has a sheet configuration, the fiber 100 may be deposited on the collector 5 that is wound onto a roll, etc.

Also, the collector 5 may be able to move. For example, a pair of rotating drums and a driving part that rotates the rotating drums may be provided; and the collector 5 that has the sheet configuration may be caused to move between the pair of rotating drums like a belt conveyor. Thus, a continuous deposition operation is possible because the region where the fiber 100 is deposited can be caused to move. Therefore, the production efficiency of a deposited body 110 made of the fiber 100 can be increased.

The deposited body 110 that is formed on the collector 5 is removed from the collector 5. For example, the deposited body 110 is used in a nonwoven cloth, a filter, etc. The applications of the deposited body 110 are not limited to the illustration.

Also, the collector 5 can be omitted. For example, the deposited body 110 that is made of the fiber 100 can be directly formed on the surface of a conductive member. In such a case, it is sufficient to ground the conductive member or to apply to the conductive member a voltage having the reverse polarity of the voltage applied to the nozzles 20.

Here, there are cases where the first liquid adheres to the tip of the nozzle 20 when the first liquid is ejected continuously for a long period of time or when the ejecting and the stopping of the ejecting of the first liquid are repeatedly performed. When the adhesion first liquid coalesces and solidifies by drying, there is a risk that the amount of the ejected first liquid may decrease; and the first liquid may no longer be ejected. Therefore, the end portion vicinity of the nozzle 20 is cleaned regularly or as necessary. Generally, the first liquid that is adhered to the end portion vicinity of the nozzle 20 is wiped before solidifying.

However, the strength of the nozzle 20 is low because the nozzle 20 has a needle-like configuration. Therefore, it is necessary to clean the multiple nozzles 20 one at a time. However, by doing so, the burden of the operator becomes too great. Also, there is a risk that the time necessary for the cleaning may lengthen; and the productivity may decrease. Further, when the first liquid that is adhered to the end portion vicinity of the multiple nozzles 20 is directly wiped, there is a risk that the nozzle 20 may bent or the nozzle 20 may be damaged. In such a case, if the nozzle 20 bends, there is a risk the deposited body 110 may no longer be formed in the intended region.

Also, if a wiping mechanism is provided at the vicinity of the nozzle head, there is a risk that the electric field that is generated between the collector 5 and the nozzles 20 may be affected; and the formation of the fiber 100 may become unstable.

Therefore, in the electrospinning apparatus 1 according to the embodiment, the cleaning nozzle 23 and the cleaning liquid supplier 6 are provided; and the cleaning liquid 120 is supplied to the vicinity of the outlet 20*a* of the nozzle 20 (the tip of the nozzle 20).

The cleaning liquid supplier 6 supplies the cleaning liquid 120 to the nozzle 23.

As shown in FIG. 1, the cleaning liquid supplier 6 includes a container 61, a supplier 62, a cleaning liquid controller 63, a pipe 64, and a drain 65.

The container 61 stores the cleaning liquid 120. The container 61 is formed from a material having resistance to the cleaning liquid 120. For example, the container 61 can be formed from stainless steel, etc.

The cleaning liquid 120 is not particularly limited as long as the first liquid can be removed. In such a case, it is favorable for the cleaning liquid 120 to be able to dissolve the polymeric substance included in the first liquid. For example, the cleaning liquid 120 may be the solvent included in the first liquid.

The supplier 62 supplies the cleaning liquid 120 stored in the container 61 to the cleaning nozzle 23 via the base 24. For example, the supplier 62 can be a pump that is resistant to the cleaning liquid 120, etc. Also, the supplier 62 may feed the cleaning liquid 120 stored in the container 61 by pressurizing by supplying a gas to the container 61.

The cleaning liquid controller 63 controls the flow rate, pressure, etc., of the cleaning liquid 120 supplied to the base 24. Also, the cleaning liquid controller 63 may switch between the start of the supply and the stop of the supply of the cleaning liquid 120.

The pipe 64 is provided between the container 61 and the supplier 62, between the supplier 62 and the cleaning liquid controller 63, and between the cleaning liquid controller 63 and the base 24. The pipe 64 is a flow channel of the cleaning liquid. The pipe 64 is formed from a material having resistance to the cleaning liquid. For example, the pipe 64 can be formed from a fluoric resin, etc. Also, the pipe 64 can be flexible. If the pipe 64 is flexible, the movement of the cleaning nozzle 23 and the base 24 described below is easy.

The drain 65 is provided at a position separated from the collector 5. The drain 65 is provided at the position where the cleaning liquid 120 is supplied from the cleaning nozzle 23. For example, the cleaning nozzle 23 supplies the cleaning liquid 120 toward the vicinity of the outlet 20*a* of the nozzle 20 above the drain 65. The drain 65 receives the supplied cleaning liquid 120 and the first liquid removed by the cleaning liquid 120 and ejects the cleaning liquid 120 and the first liquid outside the electrospinning apparatus 1. The drain 65 is formed from a material having resistance to the first liquid and the cleaning liquid 120. For example, the drain 65 can be formed from stainless steel, etc.

The movement part 7 moves the position of the nozzle head 2 and the cleaning liquid supplier 6 between the drain 65 and the collector 5. In other words, the movement part 7 moves the main body 22 between the position where the first liquid is ejected from the nozzles 20 and the position where the cleaning liquid 120 is supplied from the cleaning nozzle 23. For example, when depositing the fiber 100, the movement part 7 moves the nozzle head 2 to the position where the collector 5 is provided. When performing the cleaning of the nozzles 20, the movement part 7 moves the nozzle head 2 to the position where the drain 65 is provided.

The movement part 7 can include, for example, a guide device such as a linear motion bearing or the like, a transmission device such as a ball screw or the like, a drive device such as a servo motor, etc.

The controller 8 controls the operations of the supplier 32, the first liquid controller 33, the power supply 4, the supplier 62, the cleaning liquid controller 63, and the movement part 7.

For example, the controller 8 can be a computer including a CPU (Central Processing Unit), memory, etc.

Effects of the electrospinning apparatus 1 will now be described.

The first liquid collects at the vicinity of the outlet 20*a* of the nozzle 20 due to surface tension.

The first liquid controller 33 controls the flow rate, pressure, etc., of the first liquid supplied to the main body 22 so that the first liquid in the interior of the main body 22 is not pushed out from the outlet 20*a* when the new first liquid is supplied to the interior of the main body 22.

The power supply 4 applies a voltage to the nozzle 20. Then, the first liquid that is at the vicinity of the outlet 20*a* is charged with a prescribed polarity. In the case illustrated in FIG. 1, the first liquid that is at the vicinity of the outlet 20*a* is charged to be positive.

Because the collector 5 is grounded, an electric field is generated between the collector 5 and the nozzles 20. Then, when the electrostatic force that acts along the lines of electric force becomes larger than the surface tension, the first liquid that is at the vicinity of the outlet 20*a* is drawn out toward the collector 5 by the electrostatic force. The first liquid that is drawn out is elongated; and the fiber 100 is formed by the volatilization of the solvent included in the first liquid. The fiber 100 that is formed is deposited on the collector 5 to form the deposited body 110.

When performing the cleaning of the nozzles 20, the movement part 7 moves the nozzle head 2 to the position where the drain 65 is provided. The supplier 62 supplies the cleaning liquid 120 stored in the container 61 to the cleaning nozzle 23 via the base 24. The cleaning liquid 120 is supplied to the vicinity of the outlets 20*a* of the nozzles 20 from the cleaning nozzle 23. The drain 65 receives the cleaning liquid 120 that is dispensed and the first liquid that is removed by the cleaning liquid 120, and ejects the cleaning liquid 120 and the first liquid outside the electrospinning apparatus 1.

When depositing the fiber 100, the movement part 7 moves the nozzle head 2 to the position where the collector 5 is provided. Then, the depositing of the fiber 100 described above is performed.

In the case illustrated in FIG. 1, the cleaning nozzle 23 and the base 24 are provided at the nozzle head 2. However, the arrangement positions of the cleaning nozzle 23 and the base 24 are not limited thereto.

The cleaning nozzle 23 and the base 24 can be provided to be separated from the main body 22. In the case where the cleaning nozzle 23 is provided to be separated from the main body 22, the cleaning nozzle 23 can be provided in at least one of the drain 65 or the vicinity of the drain 65. If the cleaning nozzle 23 is provided in the vicinity of the drain 65, etc., the pipe 64 does not move with the movement of the nozzle head 2; therefore, detachment or damage of the pipe 64 can be suppressed.

Figure 2A:
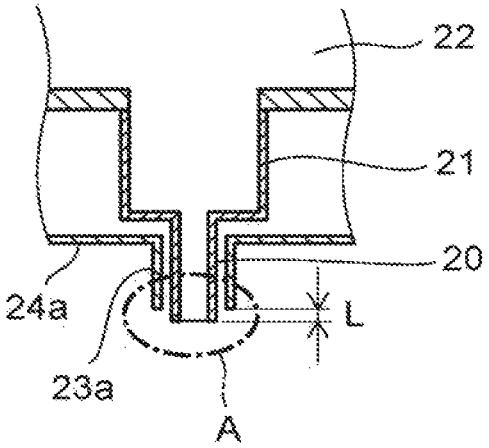
FIG. 2A is a schematic cross-sectional view for illustrating a cleaning nozzle (corresponding to an example of the second nozzle) and a base according to a second embodiment.

FIG. 2A is a schematic cross-sectional view for illustrating a cleaning nozzle 23*a* (corresponding to an example of the second nozzle) and a base 24*a* according to another embodiment.

Figure 2B:
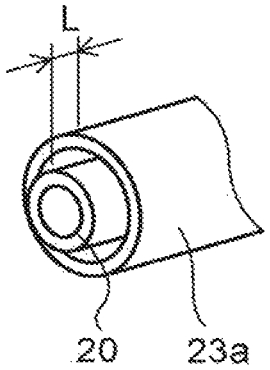
FIG. 2B is a schematic perspective view of portion A of FIG. 2A.

FIG. 2B is a schematic perspective view of portion A of FIG. 2A

As shown in FIGS. 2A and 2B, the hole for supplying the cleaning liquid 120 is provided in the interior of the cleaning nozzle 23*a*. The hole for supplying the cleaning liquid 120 communicates between the end portion of the cleaning nozzle 23*a* on a side of the base 24*a* and the end portion (the tip) on the cleaning nozzle 23*a* on the side where the cleaning liquid 120 is ejected.

The nozzle 20 is provided inside the hole of the cleaning nozzle 23*a* for supplying the cleaning liquid 120. A gap is provided between the inner wall surface of the cleaning nozzle 23*a* and the outer wall surface of the nozzle 20; and the gap is a flow channel of the cleaning liquid. The inner diameter of the cleaning nozzle 23*a* can be set to be about 0.5 mm to 2 mm. The outer diameter of the cleaning nozzle 23*a* can be set to be about 0.7 mm to 2.3 mm.

The inner diameter of the cleaning nozzle 23*a* is larger than the outer diameter of the nozzle 20.

In such a case, there is a risk that it may be difficult to control the flow of the cleaning liquid if the difference between the inner diameter of the cleaning nozzle 23*a* and the outer diameter of the nozzle 20 becomes too large. Further, there is a risk that the cleaning efficiency also may decrease.

Therefore, it is favorable for the difference between the inner diameter of the cleaning nozzle 23*a* and the outer diameter of the nozzle 20 to be set to be small. Thus, it becomes easy to perform cleaning in a state in which the cleaning liquid fills the gap between the cleaning nozzle 23*a* and the nozzle 20.

The base 24*a* has a plate configuration. The space where the cleaning liquid 120 is stored is provided in the interior of the base 24*a*. The cleaning nozzle 23*a* is provided at one end portion of the base 24*a*. The hole that is provided in the cleaning nozzle 23*a* communicates with the space provided in the interior of the base 24*a*.

The nozzle 20 is provided inside the hole of the cleaning nozzle 23*a* for dispensing the cleaning liquid 120. Therefore, the first liquid that is adhered to the tip of the nozzle 20 can be removed effectively because the cleaning liquid 120 is dispensed along the outer wall of the nozzle 20.

Also, if the nozzle 20 is provided inside the hole of the cleaning nozzle 23*a*, the electric field that is generated between the collector 5 and the nozzle 20 is not affected easily even when the cleaning nozzle 23*a* is formed from a conductive material such as a metal, etc.

Therefore, the material of the cleaning nozzle 23*a* may be a conductive material such as stainless steel or the like, an insulating material such as a resin, a ceramic, etc.

Also, as shown in FIGS. 2A and 2B, if the tip of the nozzle 20 protrudes from the tip of the cleaning nozzle 23*a*, the weakening of the electric field concentration at the tip of the nozzle 20 can be suppressed. In such a case, if a protrusion amount L of the tip of the nozzle 20 is set to 0 mm (the tip of the nozzle 20 not protruding), the electric field concentration does not occur easily at the tip of the nozzle 20. On the other hand, if the protrusion amount L becomes too large, there is a risk that the flow of the cleaning liquid may become turbulent; and the periphery of the nozzle 20 may not be cleaned efficiently.

According to knowledge obtained by the inventor, it is favorable for the protrusion amount L of the tip of the nozzle 20 to be set to be not less than 1 mm and not more than 20 mm.

Figure 3:
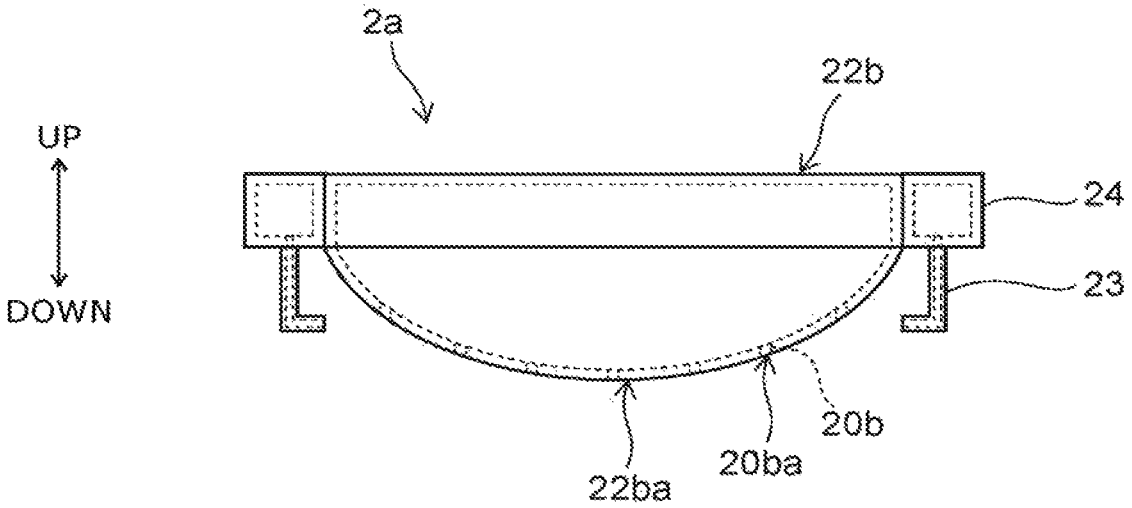
FIG. 3 is a schematic view for illustrating a nozzle head according to another embodiment.

FIG. 3 is a schematic view for illustrating a nozzle head 2*a* according to another embodiment.

Although the nozzle head 2 described above is a so-called needle-type nozzle head, the nozzle head 2*a* illustrated in FIG. 3 is a so-called blade-type nozzle head.

The nozzle head 2*a* includes a nozzle 20*b* (corresponding to an example of the first nozzle), a main body 22*b*, the cleaning nozzle 23, and the base 24.

The nozzle 20*b* is a hole provided in an end portion 22*ba* of the main body 22*b*. The nozzle 20*b* is multiply provided. The arrangement, size, etc., of the nozzles 20*b* can be similar to the arrangement of the nozzles 20, the inner diameter of the nozzle 20, etc., described above. In such a case, the opening of the nozzle 20*b* is an outlet 20*ba* where the first liquid is ejected.

The main body 22*b* has a plate configuration. The space where the first liquid is stored is provided in the interior of the main body 22*b*. The cross-sectional area is small on a side of one end portion 22*ba* of the main body 22*b*. In other words, the tip of the main body 22*b* is tapered. If the tip of the main body 22*b* is tapered, the electric field concentration occurs easily; therefore, the strength of the electric field generated between the collector 5 and the tip of the main body 22*b* can be increased.

The main body 22*b* is formed from a conductive material. It is favorable for the material of the main body 22*b* to be conductive and to be resistant to the first liquid. For example, the main body 22*b* can be formed from stainless steel, etc.

The cleaning nozzle 23 and the base 24 described above can be provided at the nozzle head 2*a* as well. In such a case, the cleaning nozzle 23 can have an L-shaped configuration. If the cleaning nozzle 23 has an L-shaped configuration, it is easy to supply the cleaning liquid 120 to the end portion 22*ba* of the main body 22*b*. Therefore, it is easy to remove the first liquid adhered to the end portion 22*ba* of the main body 22*b*. Also, the base 24 can be provided at the side surface of the main body 22*b*.

The configurations, arrangement positions, numbers, etc., of the cleaning nozzle 23 and the base 24 are not limited to the illustration and can be modified appropriately according to the configuration, size, etc., of the nozzle head 2*a*.

Figure 4A:
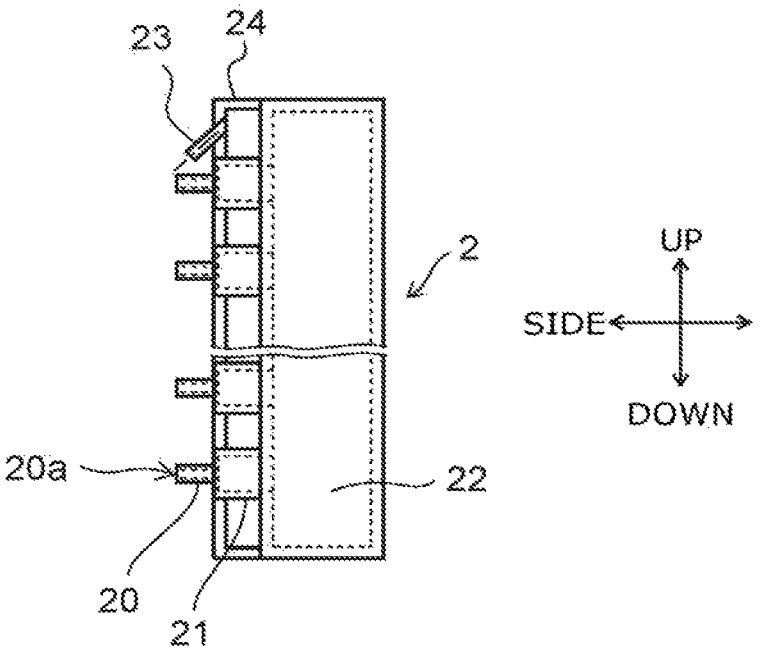
FIGS. 4A and 4B are schematic views for illustrating another mounting direction of the nozzle heads.
Figure 4B:
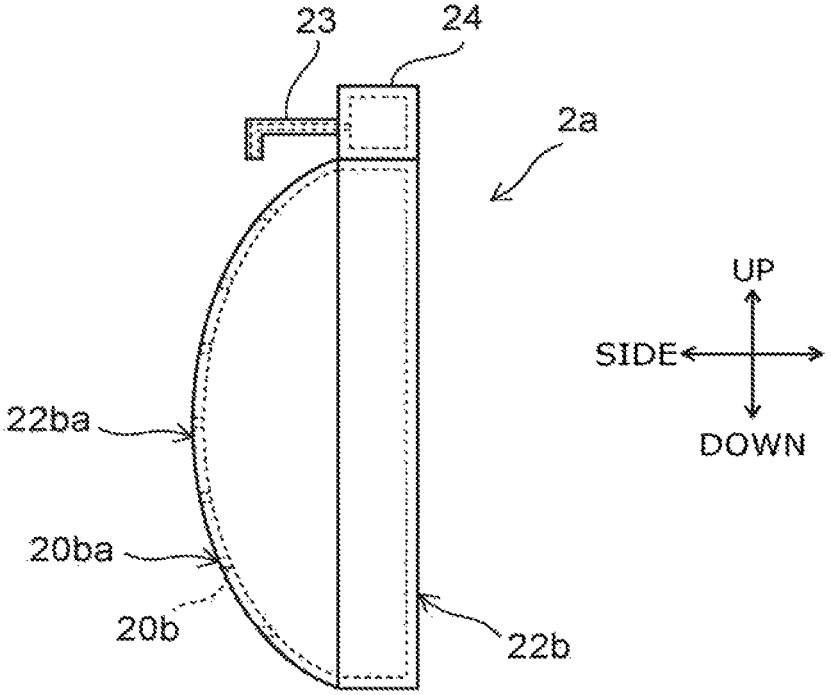

FIGS. 4A and 4B are schematic views for illustrating another mounting direction of the nozzle heads 2 and 2*a*.

In the case where the first liquid is ejected downward, the mounting directions of the nozzle heads 2 and 2*a* can be those illustrated in FIG. 1 and FIG. 3.

Conversely, in the case where the first liquid is ejected toward the side, the mounting directions of the nozzle heads 2 and 2*a* can be as those illustrated in FIGS. 4A and 4B.

In such a case, the cleaning nozzle 23 can be provided only on the upper side. The cleaning liquid 120 that is supplied from the cleaning nozzle 23 flows downward due to gravity. Therefore, the cleaning liquid can be supplied to the multiple nozzles 20 and 20*b* even if the cleaning nozzle 23 is provided only on the upper side. Thus, simplification of the configurations of the nozzle heads 2 and 2*a* and a decrease of the manufacturing cost can be realized.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A nozzle head, comprising:

a main body having an interior space capable of storing a source material liquid;

a first nozzle provided at the main body configured to eject the source material liquid stored in the interior space, the first nozzle comprising a first tip wherefrom the source material liquid is ejected;

a second nozzle provided at the main body configured to supply a cleaning liquid while the first nozzle is not ejecting the source material liquid, the second nozzle comprising a hole with a second tip wherefrom the cleaning liquid is supplied; and a driver configured to move the main body between first and second positions, said first position being where the source material liquid is ejected from the first nozzle and said second position being where the cleaning liquid is supplied from the second nozzle, wherein, the first nozzle is provided inside the hole of the second nozzle such that the first tip protrudes from the second tip, and a protrusion amount of the first tip from the second tip is set to be not less than 1 mm and not more than 20 mm.

2. The nozzle head according to claim 1, wherein the cleaning liquid includes a solvent included in the source material liquid.

* * * * *